United States Patent [19]

Roberts et al.

[11] 4,226,486

[45] Oct. 7, 1980

[54] CONVERTIBLE TABLE STRUCTURE FOR SEWING MACHINES

[75] Inventors: Kent S. Roberts; Brent J. Roberts; Fredrick D. Roberts, all of American Fork, Utah

[73] Assignee: Roberts Mfg., Inc., American Fork, Utah

[21] Appl. No.: 974,332

[22] Filed: Dec. 29, 1978

[51] Int. Cl.[2] ..... A47B 81/00; D05B 75/00

[52] U.S. Cl. ..... 312/21; 312/26; 312/30; 112/217.1; 108/96

[58] Field of Search ..... 312/29, 30, 21, 22, 312/23, 24, 25, 26, 208; 108/17, 92, 13, 99, 96; 112/217.1

[56] References Cited

U.S. PATENT DOCUMENTS

| | | | |
|---|---|---|---|
| Re. 28,835 | 6/1976 | Roberts et al. | 312/29 |
| 809,240 | 1/1906 | Baurmann | 312/26 |
| 831,515 | 9/1906 | Kundtz et al. | 312/26 |
| 1,676,108 | 7/1928 | Novak | 108/17 |
| 2,575,725 | 11/1951 | McKay | 108/96 |
| 2,738,248 | 3/1956 | Berker | 312/29 |
| 2,790,689 | 4/1957 | Hubbell | 312/21 |
| 3,384,037 | 5/1968 | Blevins | 108/17 |
| 3,726,237 | 4/1973 | Devey et al. | 108/92 |
| 4,108,512 | 8/1978 | White | 312/30 |
| 4,135,463 | 1/1979 | Lacasse | 312/29 |

*Primary Examiner*—Victor N. Sakran

*Attorney, Agent, or Firm*—Mallinckrodt & Mallinckrodt

[57] ABSTRACT

A convertible table structure, providing a planar table top adapted, among other things, to support an open-arm or portable type of sewing machine, includes an apertured platform providing the table top and having a platform section fitting the aperture and adapted to mount the sewing machine so it can be lowered to a position wherein its working surface is coplanar with the work top of the platform proper. Link means, such as parallel motion mechanism, attaches the platform section to the platform proper, and means, such as a specially shaped lever rod, is provided for moving the platform section between its coplanar position and a lowered position, as well as for locking the platform section in its coplanar position. Other means are provided for holding such platform section in a selected lowered position. Legs or other suitable structure, such as a cabinet, supports the platform at a convenient working level.

10 Claims, 7 Drawing Figures

CONVERTIBLE TABLE STRUCTURE FOR SEWING MACHINES

BACKGROUND OF THE INVENTION

1. Field

The invention is in the general field of work tables and cabinets and is specifically concerned with table structure for types of sewing machines that must be supported below table top level if their normal working surfaces are to be coplanar with their table top.

2. State of the Art

Various special work tables and cabinets for sewing machines have been developed in the past to enable an open-arm type of sewing machine to be supported either in open-arm work position or in normal work position. For example, Devey et al. U.S. Pat. No. 3,726,237 discloses a sewing machine table having two table tops, one of which is movable in relation to the other, so that an open-arm sewing machine resting on the stationary top can be accommodated in either conventional or open-arm working position by moving the second table top.

In some instances it is desirable to have both table tops coplanar, so that the table can be used for purposes other than holding a sewing machine. Blevins U.S. Pat. No. 3,384,037 shows such a table, having a top section that can be raised from a coplanar position with respect to a stationary top section. However, the table currently made under the Blevins patent has a secondary support in the nature of an additional table under the two table top sections to give such sections stability in the coplanar position.

Roberts et al. U.S. Pat. No. Re. 28,835 discloses a sewing machine cabinet wherein a drop mount for a sewing machine is provided in the cabinet below an apertured top of the cabinet. The drop mount raises or lowers a sewing machine thereon in relation to the top of the cabinet so the machine may be used in normal or in open-arm positions. The drop mount in such cabinet, however, does not rise to a position in which its surface is coplanar with the top of the cabinet, and it is attached to and supported on a lower shelf or similar panel support.

There is still need for a sturdy sewing machine table which can accommodate an open-arm sewing machine in both normal and open-arm working positions, which forms a flat and level table surface when the sewing machine is removed therefrom so that the table may be used for other purposes, and which can be produced at low cost.

SUMMARY OF THE INVENTION

In accordance with the invention, a table structure convertible from one having a normal flat and level table top to one having a section lowered to an extent necessary to properly accommodate an open-arm sewing machine in normal work position, rather than in open-arm work position, or a so-called portable sewing machine in effective work position, is provided by an apertured platform supported at a convenient working level by either table legs or by a cabinet of some kind. The platform is apertured, preferably wholly within the peripheral margins thereof, to accommodate a sewing machine, and a platform section is movably fitted into the aperture for mounting a sewing machine and for lowering it to a normal working level. The platform section normally has its working surface coplanar with the working surface of the platform proper to provide therewith a flat and level table surface that can be used as a table for a variety of purposes if the sewing machine is removed.

Link means, such as parallel motion mechanism comprising two links of generally U shape, movably attaches the platform section to the platform proper, and means, such as a specially shaped lever rod, is provided for moving the platform section between its lowered position and its raised coplanar position. Such lever rod is advantageously provided with a handle member and is formed so as to securely lock the platform section in its coplanar position.

It is preferred that the distance the platform section stops below the platform be selectively adjustable so that a variety of makes of sewing machine may be accommodated, and it is preferred that an insert piece be provided to fill in the aperture about the open-arm of a sewing machine when the machine is in its normal working position, thus forming a substantially continuous working surface from the sewing machine to the work top of the platform proper.

The platform proper and the platform secton are preferably cut from a single panel of material, the platform section being the piece that is cut from the panel to form the aperture. No additional material in the form of structural reinforcing or a secondary supporting platform is necessary. The link means and the lever rod moving means firmly support the platform section in either raised or lowered position with or without a sewing machine carried thereby.

THE DRAWINGS

The best mode presently contemplated for carrying out the invention is illustrated in the accompanying drawings in which:

FIG. 1 is a perspective view looking downwardly toward a front corner of a convertible table structure in accordance with the invention, the platform proper being supported by table legs and the platform section being shown in its raised, coplanar position with an open-arm sewing machine indicated thereon in phantom as being in its open-arm working position;

FIG. 2, a similar perspective view showing the platform section and a sewing machine thereon in lowered, normal working position, an insert piece having been installed in the aperture about the sewing machine arm, the lower portions of two of the supporting legs being broken away for convenience of illustration;

FIG. 3, a horizontal section taken on the line 3—3 of FIG. 1 to show the table structure in bottom plan;

FIG. 4, a fragmentary vertical section taken on the line 4—4 of FIG. 1;

FIG. 5, a fragmentary vertical section taken on the line 5—5 of FIG. 2;

FIG. 6, a fragmentary vertical section taken on the line 6—6 of FIG. 1; and

FIG. 7, a fragmentary vertical section taken on the line 7—7 of FIG. 2.

DETAILED DESCRIPTION OF THE ILLUSTRATED EMBODIMENT

In the presently preferred form shown, the invention is incorporated in a work table whose top is a platform comprising an elongate platform proper 10, supported by legs 11 of any suitable type, preferably foldable against the underside of the platform to provide convenient portability and to reduce space needed for storage when not in use.

The platform is apertured at 12 in shape and size to accommodate a sewing machine 13, and a platform section 14 is loosely fitted into the aperture for receiving and supporting the sewing machine 13. As illustrated, it is preferred that the aperture be located wholly within the peripheral margins of the platform.

Figure 2:
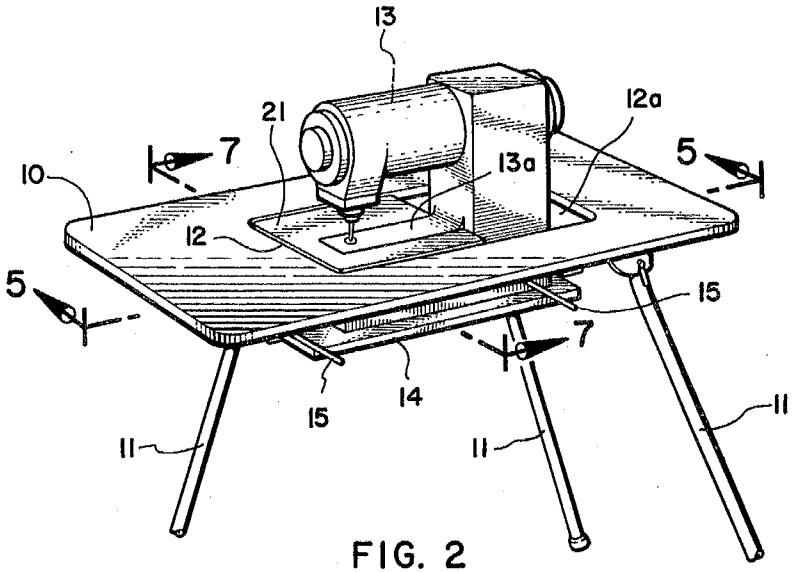
Figure 1:
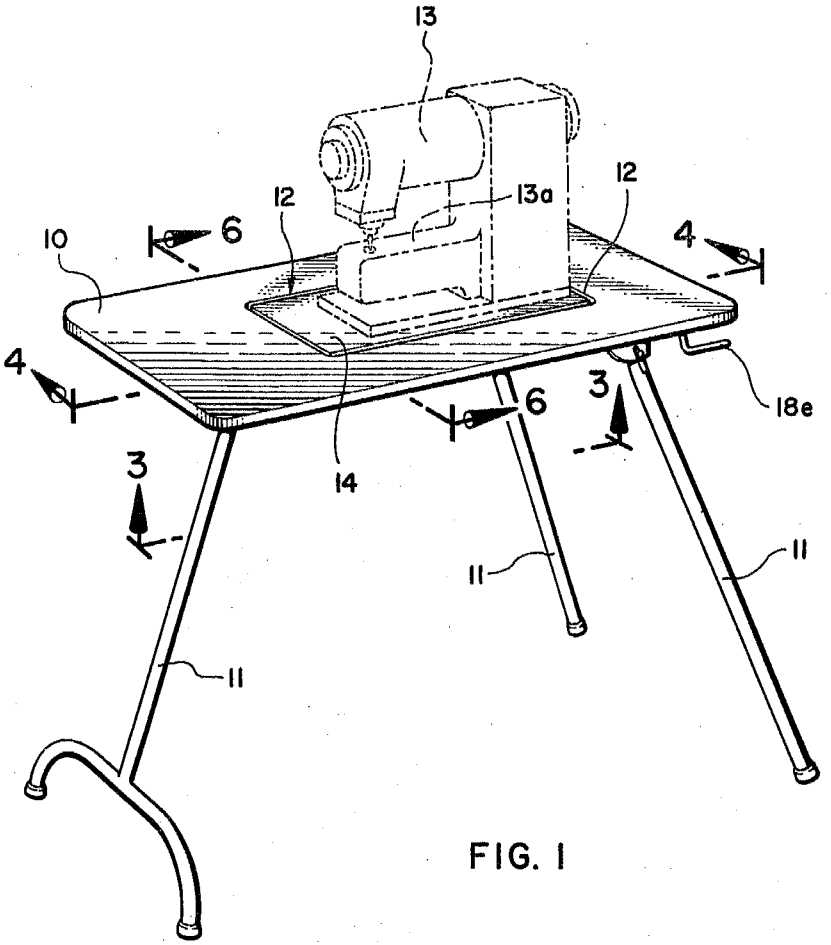
Figure 4:
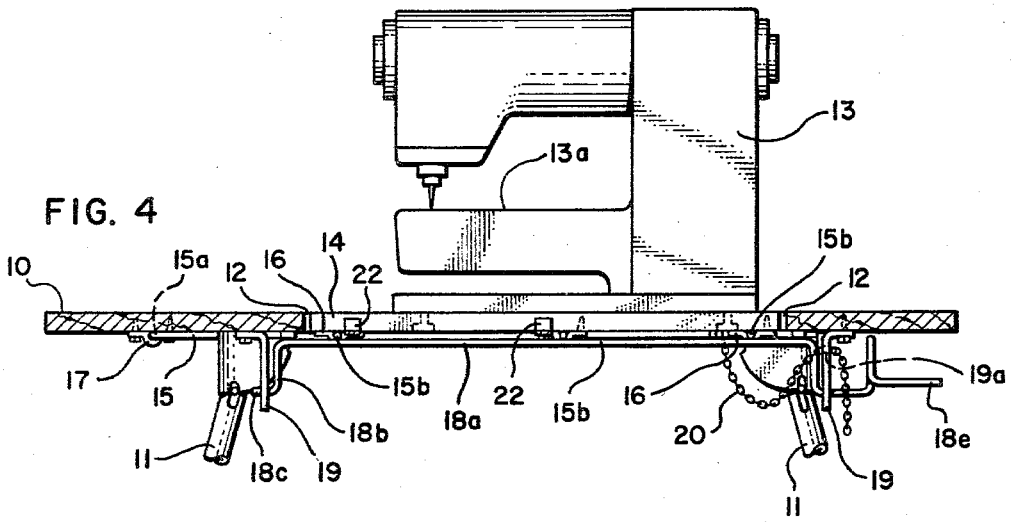
Figure 5:
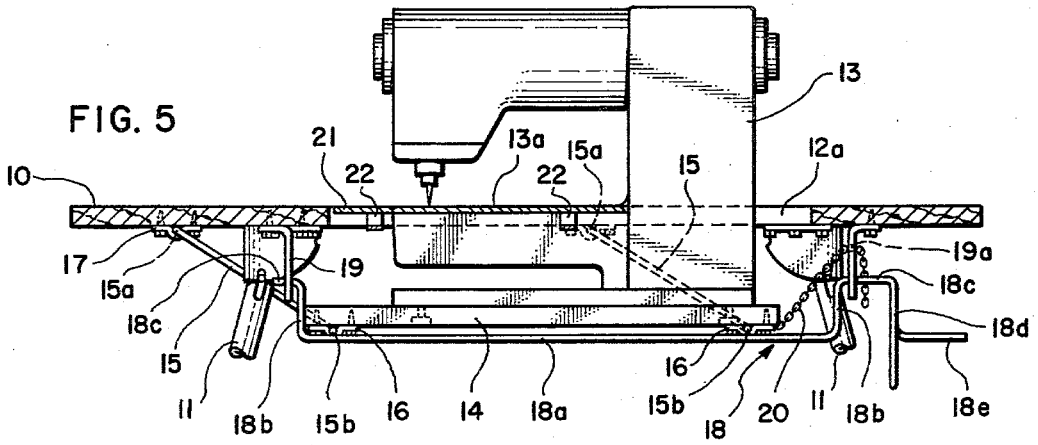
Figure 6:
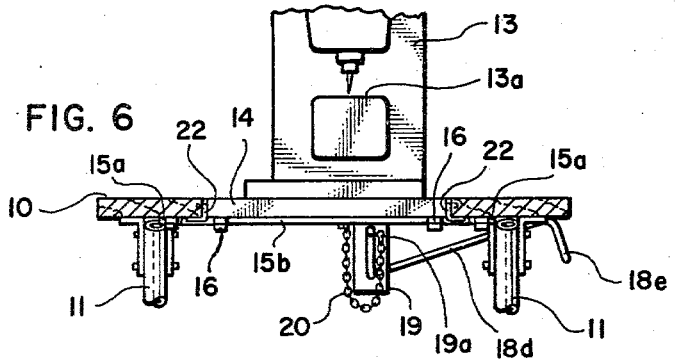
Figure 7:
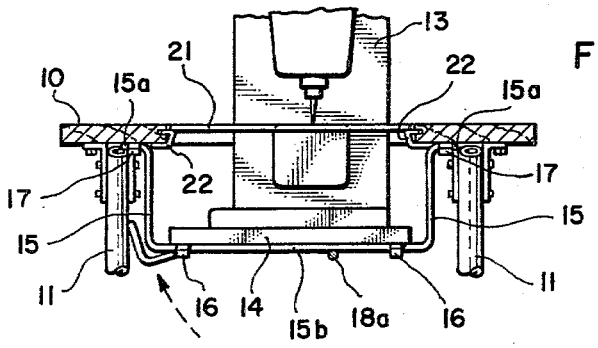

Platform section 14 is adapted for movement from its position within the aperture, wherein its top surface is coplanar with the top surface of platform proper 10 and sewing machine 13 is in its open-arm working position, in FIGS. 1, 4, and 6, to a lowered position wherein the sewing machine is placed in its normal working position with its working surface 13*a* substantially flush with the work top of the platform, as in FIGS. 2, 5, and 7. For this purpose, platform section 14 is secured to platform proper 10 by link means, preferably parallel motion mechanism.

Figure 3:
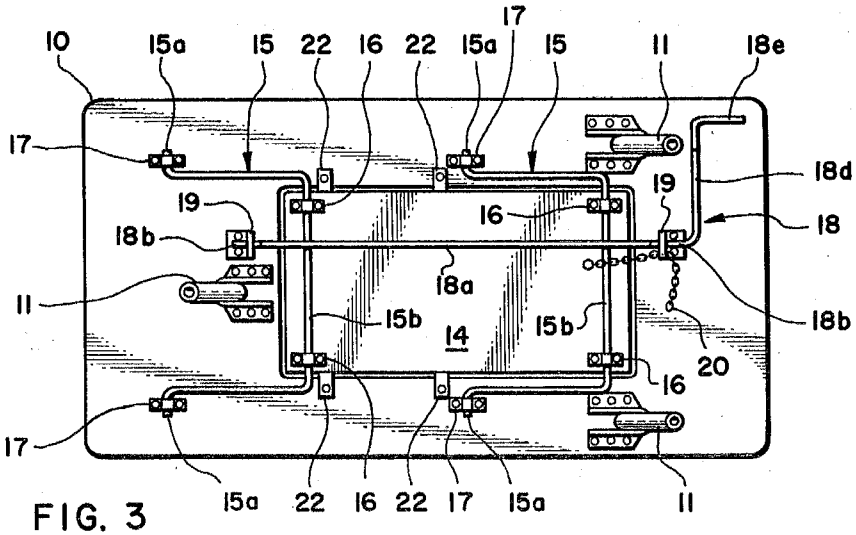

As shown, the parallel motion mechanism comprises two links 15 of generally U shape, each link having the free end of each leg of the U bent outwardly parallel with the straight bottom 15*b* of the U as an extension 15*a*, FIGS. 3 and 7. Such bottom 15*b* of each link extends transversely across platform section 14 and is secured thereto by mutually spaced bearing brackets 16. The link extensions 15*a* are rotatably secured to the underside of platform proper 10 by similar bearing brackets 17.

In this manner, platform section 14 is free to move between its coplanar position, in which links 15 are flat against the bottom of the platform, to a maximum distance below the platform equal to the length of the legs of the U links. In practice, however, platform section 14 is not lowered to the maximum extent, and the legs of U links 15 are made sufficiently long to minimize horizontal displacement of the platform section in moving it from its coplanar to its lowered position and vice versa.

Manually operable lever means are provided for lowering and raising platform section 14 and the sewing machine mounted thereon. Such means preferably comprises a lever rod 18 rotatably secured in an offset manner to the platform, below and at opposite sides, here the ends, of aperture 12. Such lever rod has a straight portion 18*a* disposed under the aperture and offset from the level of rod securement by bends in the rod that provide output lever arms 18*b*, so that, when the lever rod is in raised position, straight portion 18*a* is just past dead center and holds platform section 14 in the normal, coplanar position of FIGS. 1, 4, and 6, and, when the lever rod is rotated, such straight portion thereof drops and allows the platform section to fall into a lowered position.

As illustrated, lever rod 18 is bent further to provide fulcrum portions 18*c*, which are journaled in respective bearing plates 19 that depend from securement to the underside of platform proper 10, and is bent still further to provide an input lever arm 18*d* terminating in a handle portion 18*e*.

Although it is economical to fabricate the lever means by bending an elongate metal rod to proper formation, as described above, it should be realized that a similar lever arrangement can be provided in other ways.

In the form illustrated, see particularly FIG. 5, the length of output arms 18*b* of lever rod 18 and the position of the one toward which platform section 14 swings as it is being lowered together determine the maximum drop of platform section 14, although it is obvious that either alone could do so, and such lever rod thereby serves to support the platform section and the sewing machine carried thereby when in that lowest position. However, it is desirable that the extent of drop and the lowered position of the platform section be adjustable to fit various makes of sewing machine and to further minimize the drop of platform section 14. For this purpose, a chain 20 has one end secured to the underside of platform section 14 adjacent to one of the bearing plates 19 and the other end free. The bearing plate 19 concerned is provided with a chain anchoring formation, here shown as merely a hole 19*a* through which the free end of the chain is passed to the desired extent, the diameter of the hole being less than the length of a single link of the chain, anchoring is accomplished by merely swiveling one of the links crosswise of the hole at the chain free end side of the plate, so that it bears firmly against that side of the plate.

Since in the lowered position of platform section 14 there is usually a rather wide gap portion of aperture 12 surrounding the working surface, 13*a*, of the sewing machine at the level of the work top of platform section 10, see 12*a*, FIGS. 2, 5, and 7, it is desirable to provide an insert piece 21 for at least that portion of the gap surrounding the sewing machine's working surface, 13*a*.

For supporting the insert piece, while still enabling platform section 14 to fit snugly in aperture 12 in its raised position, spring clips 22 are provided at intervals along the inside edge faces of platform proper 10 which define the aperture. These are of sloping formation from lower ends to upper ends thereof and their horizontal upper ends are slidable in respective receiving slots provided in platform proper 10. Thus, they serve to support insert piece 21 when platform section 14 is in a lowered position, see FIG. 7, but are pushed out of the way when such platform section is raised to its coplanar position with the platform proper, see FIG. 6.

Constructed as it is, the table structure of the invention is sturdy, is convenient to convert from multi-use coplanar condition to a condition which places a sewing machine in position for effective normal use, and can be produced at relatively low cost.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A convertible table structure providing support and dual working surfaces for an open-arm or portable type of sewing machine, comprising an apertured platform having a work top and an underside, the aperture therein being of a size to accommodate the working portions of the sewing machine; a platform section adapted to receive thereon a sewing machine and being of size normally fitting closely within the aperture in the platform proper coplanar with the platform work top, said platform section being movable from the normal, coplanar position to a position below the work top, so a sewing machine mounted thereon is placed in suitable working position with respect to the work top, and vice versa, so as to re-establish the coplanar relationship between platform section and platform proper; elongate, parallel motion, link means movably attaching said platform section to said platform proper, so as to minimize horizontal movement of the platform section in moving vertically from coplanar position to lowered position and vice versa; means attached to the underside of the platform for moving said platform section between its said normal, coplanar position and a lowered position and vice versa, said means for moving the platform section being adapted to limit the extent of downward movement of said link means so as to minimize horizontal movement of the platform section as it is lowered and raised and so as to support the platform section in a maximum lowered position; and means for supporting the platform proper at a convenient working level.

2. A convertible table structure according to claim 1, wherein the means for moving the platform section between its normal, coplanar position and the maximum lowered position comprises an elongate lever rod pivotally secured to the platform proper below and at one set of mutually opposite sides of the aperture, said lever rod having a substantially straight portion disposed under the aperture and offset from the level of said pivotal securement by bends in the rod, so that, when the lever rod is in one position, the platform section is held in its normal, coplanar position, and when the lever rod is rotated in said pivotal securement, the platform section falls into a lowered position, said lever rod having a handle portion by which it can be rotated.

3. A convertible table structure according to claim 1, wherein there is additionally provided means for holding the platform section in a selected lowered position short of the maximum so the position below the work top at which the platform section stops to place a sewing machine mounted thereon in a normal working position with respect to the work top can be selected to suit a given sewing machine.

4. A convertible table structure according to claim 1, wherein there is additionally included removable insert means for fitting into the portion of the aperture not occupied by the sewing machine when placed in a normal working position, so as to provide a substantially continuous, coplanar working surface about the sewing machine and to the outer periphery of the platform proper; and wherein supporting means are provided about the wall of the aperture to support the insert, said supporting means comprising a number of spring clips secured to the platform proper so as to extend into the aperture to support the insert when in use, at least some of said spring clips being constructed and arranged to be forced into the walls of the aperture when the platform section is raised to coplanar position so that said platform section fits snugly in the aperture.

5. A convertible table structure according to claim 1, wherein the aperture in the platform is wholly within the peripheral margins of the platform.

6. A convertible table structure according to claim 2, wherein the link means movably attaching the platform section to the platform proper comprises parallel motion mechanism having two U-shaped links, each of the two legs of each U link having an extension at its upper end bent outwardly, so as to be parallel with the bottom of the U link, and pivotally attached to the underside of the platform proper, and said bottom of each U link being pivotally attached to the underside of the platform section.

7. A convertible table structure according to claim 6, wherein the bottoms of the respective U links extend across the platform section transversely of the lever rod and between the lever rod and the underside of the platform section, so the lever rod bears against the bottoms of the U links during lowering and raising movement of said platform section.

8. A convertible table structure according to claim 2, wherein the straight portion of the lever rod is so arranged with respect to the handle thereof that, in raising the platform section to its coplanar position from a lowered position thereof, such lever rod is rotated so the offset straight portion just passes dead center to prevent further rotation of the lever rod and to effectively lock the platform section in its coplanar position.

9. A convertible table structure according to claim 3, wherein the means for holding the platform section in a selected position below the work top includes elongate chain means attached to the platform section, and chain anchoring means, one being attached to the platform section and the other being attached to the platform proper, so the chain means may be anchored at selected intervals along its length to provide variable length portions of said chain means effective to stop descent of said platform section at selected levels.

10. A convertible table structure according to claim 9, wherein the means for moving the platform section between its normal, coplanar position and a lowered position comprises a lever rod pivotally secured to the platform proper below and at one set of mutually opposite sides of the aperture, said lever rod having a substantially straight portion disposed under the aperture and offset from the level of said pivotal securement by bends in the rod, so that, when the lever rod is in raised position, the said straight portion is just past dead center and holds the platform section in its normal, coplanar position, and when the lever rod is rotated in said pivotal securement, said straight portion allows the platform section to fall into a lowered position, the lever rod having a handle portion by which it can be rotated; wherein the lever rod is pivotally secured in mutually spaced bearing plates depending from securement to the underside of the platform proper; and wherein the chain anchoring means is an anchoring formation provided by one of said bearing plates.

* * * * *